US005664828A

United States Patent [19]

Simon

[11] Patent Number: 5,664,828

[45] Date of Patent: Sep. 9, 1997

[54] SUPPORT DEVICE FOR USE IN SIMULTANEOUS NURSING OF TWIN INFANTS

[76] Inventor: Janet Y. Simon, 209 Clearwood Ct., St. Peters, Mo. 63376

[21] Appl. No.: 527,363

[22] Filed: Sep. 12, 1995

[51] Int. Cl.[6] ..... A47C 7/68; A47D 13/00

[52] U.S. Cl. ..... 297/153; 297/135; 297/464

[58] Field of Search ..... 297/135, 153, 297/174, 182, 219.1, 464; 100/90

[56] References Cited

U.S. PATENT DOCUMENTS

| | | | |
|---|---|---|---|
| 2,683,482 | 7/1954 | Puls | 297/136 |
| 2,954,635 | 10/1960 | Stotter | 108/90 X |
| 3,353,867 | 11/1967 | Anderson | 108/90 X |
| 3,490,808 | 1/1970 | Siegel | 297/153 |
| 3,558,186 | 1/1971 | Shore et al. | 297/136 |
| 3,788,699 | 1/1974 | Starr | 297/153 X |
| 4,453,764 | 6/1984 | Hennessey | 297/153 |
| 4,750,402 | 6/1988 | Markey | 108/90 |
| 4,906,043 | 3/1990 | Davis et al. | 297/153 |
| 4,936,628 | 6/1990 | Delaney et al. | 297/153 X |
| 5,310,244 | 5/1994 | Borgardt | 297/153 |
| 5,339,748 | 8/1994 | Bilotti | 108/90 |
| 5,558,391 | 9/1996 | Chavous | 297/153 |

OTHER PUBLICATIONS

Instructions for use of the Nurse Mate™ (1994) Four Dee Products, Houston, TX.

*Primary Examiner*—Peter R. Brown
*Attorney, Agent, or Firm*—Kalish & Gilster

[57] ABSTRACT

A device for support of two infants for simultaneous feeding thereof by a sole user includes a rigid platform disposed on arms of a chair in which the user of the device is seated. A cushion is disposed on the rigid platform upon which the infants are supported for simultaneous feeding by the user of the device.

17 Claims, 5 Drawing Sheets

SUPPORT DEVICE FOR USE IN SIMULTANEOUS NURSING OF TWIN INFANTS

BACKGROUND AND SUMMARY OF THE INVENTION

The present invention relates, generally to the field of infant support devices, and more specifically, to a device for supporting human infants for simultaneous nursing by a woman of more than one infant.

Feeding multiple infants, such as twins and triplets, requires a great deal of the mother's time. This is the case whether the babies are bottle fed or breast fed. Especially when the infants are breast fed, if only one baby is fed at a time, the mother may have to spend up to ten hours per day nursing. Thus, any means for facilitating this process is welcomed by the mother.

It is particularly helpful to the nursing mother of multiple infants if she can have her hands free so that other tasks may be attended to while the babies are feeding.

Previously, mothers of multiple infants who wanted to feed two babies at once generally propped themselves in bed or on a couch and supported the babies on pillows stacked around the mother. Clearly this position is very limiting in that the babies must be held at all times to keep them from shifting out of the desired position, or even tumbling off the pillows to the floor. Necessarily, in the above-described position, the mother's hands are generally occupied attending to the positioning of the infants. Further, the soft, uneven surroundings tend to make it difficult for a woman nursing in this position to do anything else constructive during the nursing time.

The only other known product which has attempted to address these needs has been marketed and sold in medical supply retailing facilities from at least about 1991 or 1992 under the trade name, NURSE MATE by Four Dee Products of Houston, Tex. This product is essentially a soft, flat pillow with a convoluted top. The pillow is fitted around the mother's waist and is connected to her by a strap around her back. For use of this known device, the mother sits on a couch or in bed or in a wide armchair and positions the pillow to rest an her lap. A bed pillow beneath the known product provides extra height if necessary.

By contrast the present invention is not supported by the mother's body, but by the arm rests of a chair, such as a rocking chair or glider, with rigid arms. The new multiple infant feeding device includes a rigid platform with parallel guides fixed on the lower surface thereof to flank the chair arms and thereby prevent lateral movement of the platform. A thick cushion is supported on the rigid platform and covered with a removable, washable soft cover which is sized for complete coverage of the cushion and which extends around the edges and beneath the lower surface of the platform where it is selectively removably secured in place.

To prevent the infants from tumbling off, straps and/or harnesses are connected to the new device, over the cover of the device and hook and loop style, or other fasteners are provided on the cover to permit the mother to keep objects such as a face cloth, toys, pacifiers, etc within easy reach.

The new multiple infant nursing device can be provided in various sizes and shapes, as desired, and as may be necessary to fit the user and the user's particular rocking chair or other seating device.

Of course, the new device is not necessarily limited to use by nursing mothers, but may also be handily used by anyone wishing to bottle feed two infants simultaneously in a convenient position with the babies safely and comfortably positioned. In this case, the adult user can be seated comfortably and have the feeding infants positioned at a convenient level. Further, the mother or other user can be more comfortable than is otherwise possible while feeding infants when the user is in recovery from surgery, such as a Caesarian Section or gall bladder operation, because the new device supports the infants without placing any pressure or painful contact on the user's body. This cannot be said of nursing or otherwise feeding infant's when propped up in bed or even when using a pillow such as the known NURSE MATE.

If the babies are mature enough to support their bottles themselves, the supervising, seated adult can still use the device as a work surface to assist in accomplishing other tasks while the babies are bottle feeding. Indeed, the new device is handy and comfortable for use as a work station even when not being used for the care and feeding of infants.

Accordingly, it is among the several objects of the present invention to provide a device for safe support of two infants for simultaneous breast feeding thereof, which device can be used by a nursing mother seated, for example, in a rocking chair, a glider, or other arm chair having hard, rigid arms upon which the new device is positioned.

It is further among the objects of the present invention, having the features indicated, that the new device permit the mother to have her hands free during much of the nursing time and also provide a sufficiently firm support surface that the surface can be used by the mother during nursing to accomplish such tasks as letter writing, sewing, placing telephone calls, etc.

It is also among the objects of the present invention, having the features indicated, that the new device be easily used by mothers of substantially all sizes and shapes, that it not actually attach to the woman using it, but is adapted for securing babies thereto in a safe and comfortable manner and be adjustable in such adaptation for securing the babies to account for their differing and/or changing sizes.

It is further among the objects of the present invention, having the features indicated, that the device be adapted for releasably retaining thereon other objects which the user may wish to have readily at hand.

Accordingly, in furtherance of the above objects, the invention is, briefly, a device for support of two infants for simultaneous feeding thereof by a sole user. The device includes a platform disposed on arms of a chair in which the user of the device is seated, and a cushion disposed on the rigid platform upon which the infants are supported for simultaneous feeding by the user of the device. The invention further includes a cover to prevent the infants from being in direct contact with the pad, and infant retention devices to prevent the babies from falling from the support platform.

These and other objects will be in part apparent and in part pointed out hereinbelow.

DESCRIPTION OF THE PREFERRED EMBODIMENT

Figure 1:
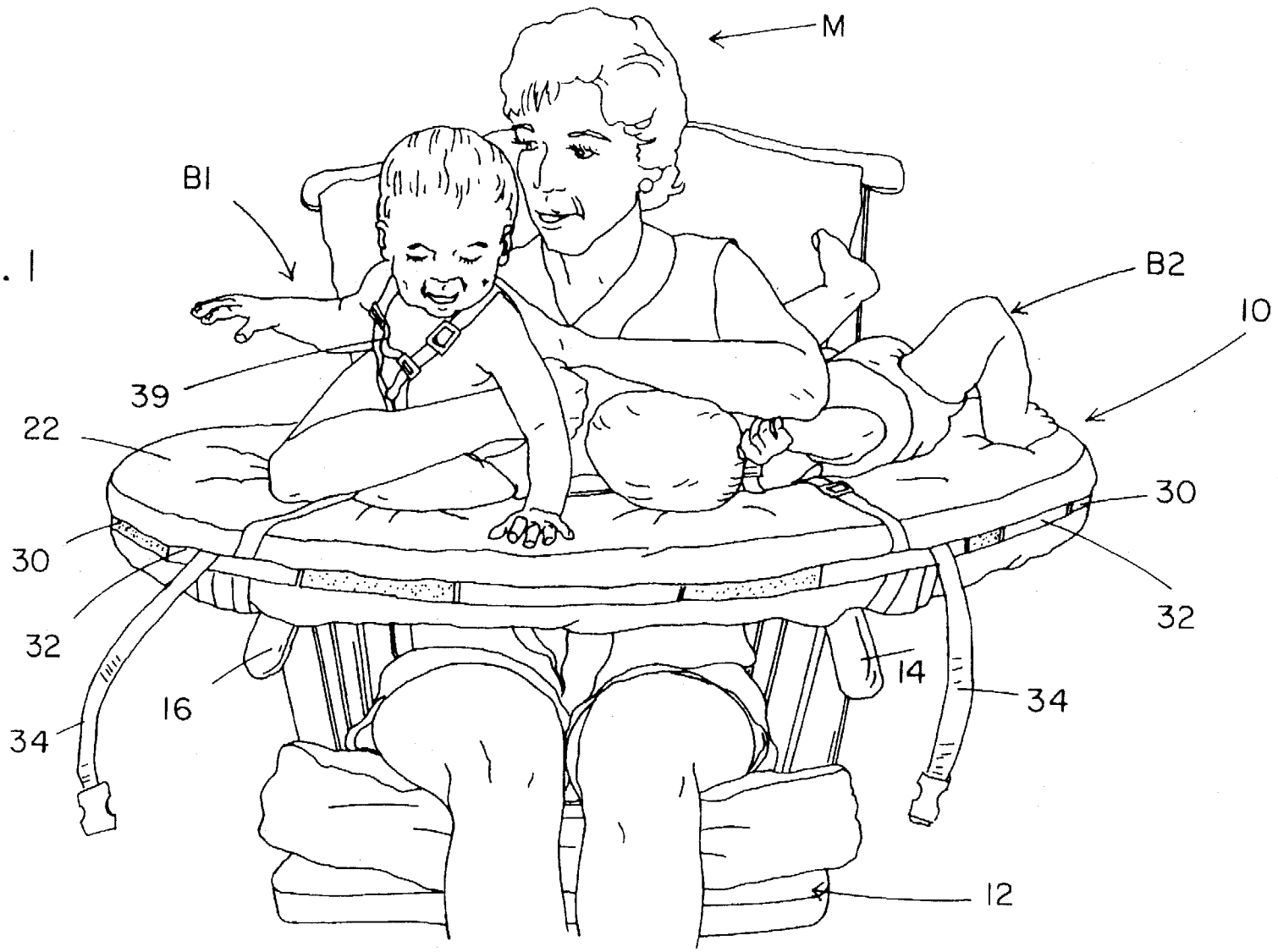
FIG. 1 is a front perspective view of the new support device shown positioned in use by the mother with two babies.

With reference to the drawings, and particularly with regard to FIG. 1, a new support device, generally designated 10, is specifically designed for use by a nursing mother M for simultaneous feeding or care of two babies B1, B2 at the same time. Device 10 is shown in normal use position on a chair 12 and is supported on the chair arms 14, 16 in a substantially horizontal position.

Figure 3:
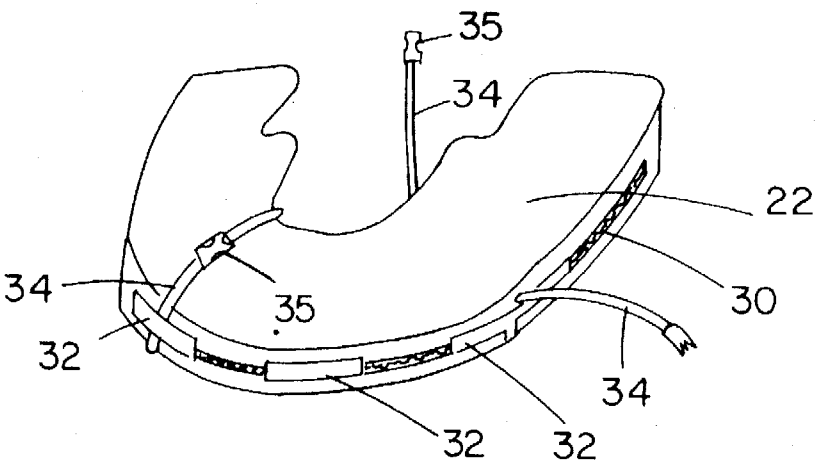
FIG. 3 is a schematic top, front perspective view of the device of FIG. 1 with the cover in place and without the people.
Figure 2:
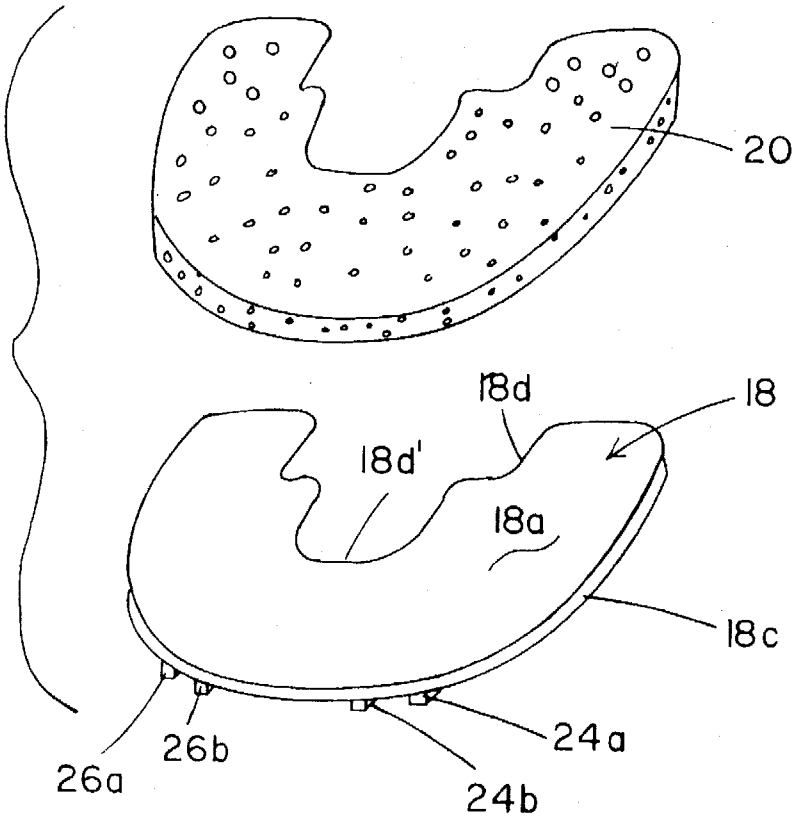
FIG. 2 is an exploded schematic view of the platform and foam pad portions of the device of FIG. 1.
Figure 8:
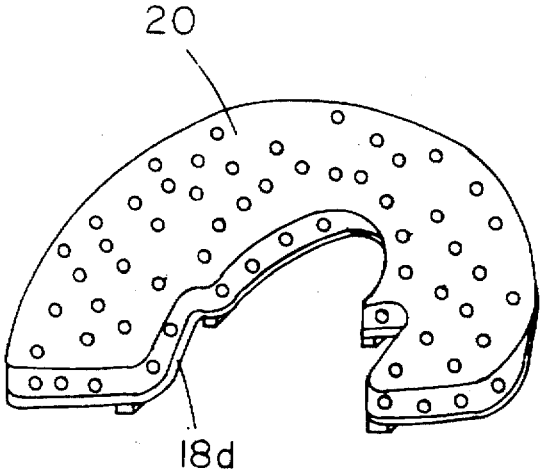
FIG. 8 is a schematic rear perspective view of the device of FIG. 1, without the cover.

As shown in FIGS. 2 and 8, support device 10 has as its basis a generally semi-circular rigid platform or base 18 upon which is supported a correspondingly sized and shaped pad or cushion 20. A cover 22 is shown in FIG. 3 which is selectively removably applied over pad 20 on platform 18 and is also preferably sized and shaped to fit the contours of the elements 18, 20.

Platform 18 is preferably formed of ½ inch thick plywood, for economy and ease of use. However, other thicknesses and types of wood or other materials can certainly be used. For example, it is forseen that the support platform could be molded of rigid or semi-rigid plastic, and can even be of the recycled variety for well-known environmental reasons.

In overall size, platform 18 can of course vary somewhat, as best suits the user's (care-giver's) needs. However, in this preferred embodiment platform 18 is approximately 42 inches wide, from left to right at its widest point (with the central cutout having a maximum of about 23 inches width), and about 10 and ¼ inches deep, from a point approximately centrally on outside edge 18*c* to a point approximately centrally on inside edge 18*d*.

Figure 5:
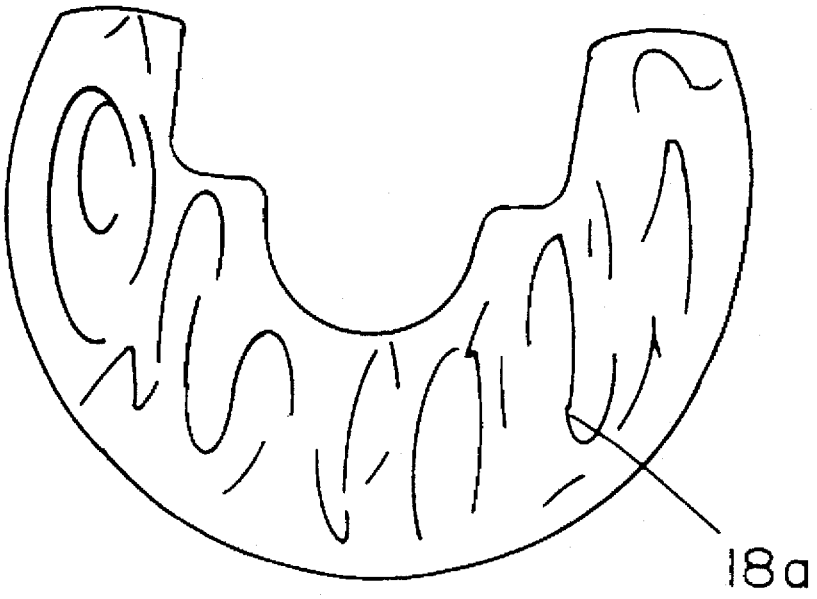
FIG. 5 is a schematic top plan view of the support platform of the device of FIG. 1 without the cover.

As shown in FIG. 2 and the top plan view of FIG. 5, platform 18 preferably is flat, with opposed upper 18*a* and lower 18*b* surfaces and has a generally arcuate or U-shaped outer edge 18*c* which curves in a concave direction in front of the seated user, and extends on each side, rearwardly on each side of the user until meeting at a curved intersection with the rearwardly extending curved inner edge 18*d*, at a point near or behind the seated user's elbow.

Inner edge 18*d*, the edge which faces the mother in normal seated used position, is preferably provided with at least one arcuate cutout area 18*d'*, and is especially desired to have a smaller central arcuate cutout extending further from the inner edge in the direction of the outer edge for ease of use and comfort. Also, the edges of the platform per se are preferably smoothed, all along the perimeter, to prevent snagging of the cover material and to reduce the likelihood of injury from inadvertently bumping the edge or any corners of the platform.

Different inner and outer platform edge shapes which may suit different users are certainly conceivable which will function adequately. For example, platform 18 could have an overall rectangular shape and still perform its intended function if otherwise formed as described hereafter and with suitable accomodations for a seated user. However, that shape is less desireable because the corners will tend to protrude inconveniently.

Figure 6:
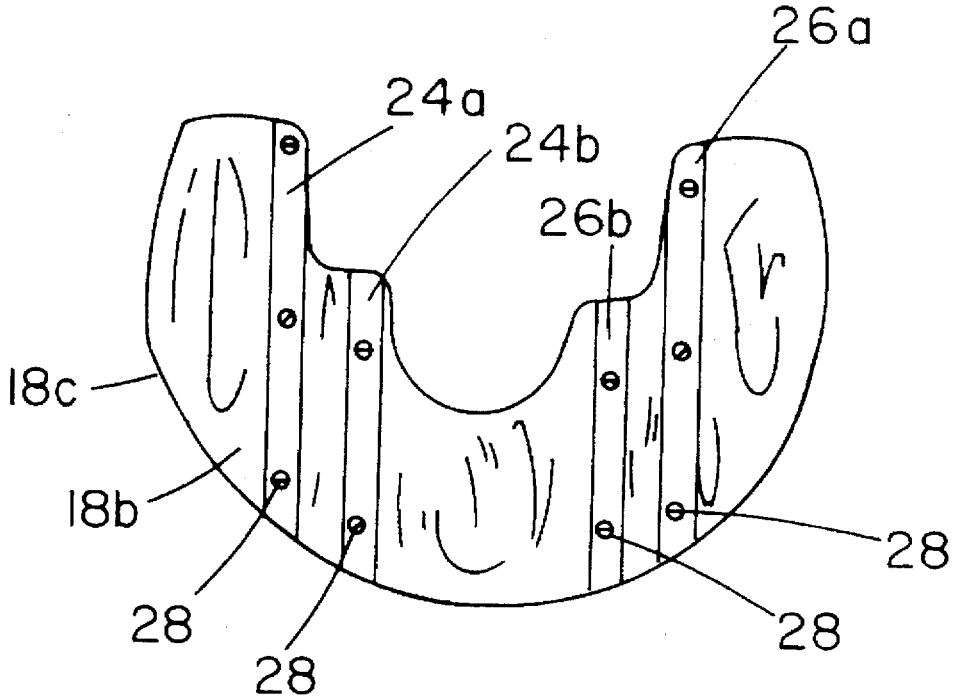
FIG. 6 is a schematic bottom plan view of the support platform device of FIG. 1 without the cover.
Figure 10:
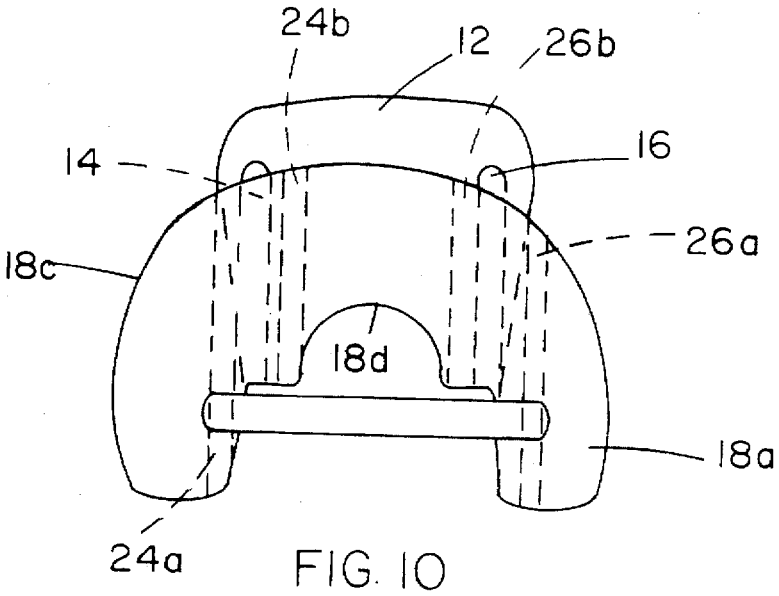
FIG. 10 is a schematic top plan view of the device of FIG. 1 in position on a substantially straight-backed arm chair, with the chair arms and the slats on the bottom of the support platform shown in phantom.

On lower surface 18*b* of platform 18 there are attached two sets of parallel, spaced apart bars 24*a*, 24*b* and 26*a*, 26*b*, which serve to flank chair arms 14, 16, respectively, as illustrated in the plan view of FIG. 10, when device 10 is in normal use position on a chair, such as chair 12. So positioned, bars 24*a*, 24*b*, 26*a*, 26*b*, prevent device 10 from inadvertantly shifting laterally and thereby prevent potentially disastrous consequences. The paired bars may be attached permanently, as by gluing or nailing in place; or, if desired, they may be selectively movably connected by bolts or screws positioned as indicated at number 28 in FIG. 6, for example, so that the relative positions of the bars can be adjusted to accomodate chair arms of a different width. In any case, the sets of paired, parallel spaced-apart bars 24*a*, 24*b* and 26*a*, 26*b*, will preferably extend from the front to the back (or outer to inner) edge of platform 18 on lower surface 18*b*.

Other methods of connecting bars 24*a*, 24*b*, 26*a*, 26*b*, to platform 18 are certainly conceivable and within the scope of the invention. Moreover, other methods for mounting platform 18 on chair C can be used without departing from the present invention, although they are not the presently preferred structure. If desired to protect the finish of chair 12 from wear due to pressure and rubbing between surfaces, a small amount of fabric or material such as polyester fill sheeting may be disposed between the tops of chair arms 14, 16 and lower surface 18*b* of platform 18.

Cushion 20 is preferred to be formed of high density foam, approximately two inches thick. However, if desired, other materials can be used and the thickness and overall shape and firmness level can vary somewhat, to suit the needs of the user. For example, if mother M is especially long waisted and/or chair arms 14, 16 are somewhat low, it may be preferred to have a thicker pad 20 so as to raise the babies on the supporting pad 20 to a more accurate height for nursing, so that mother M does not have to bend or slouch and to thus avoid causing her back strain.

Figure 7:
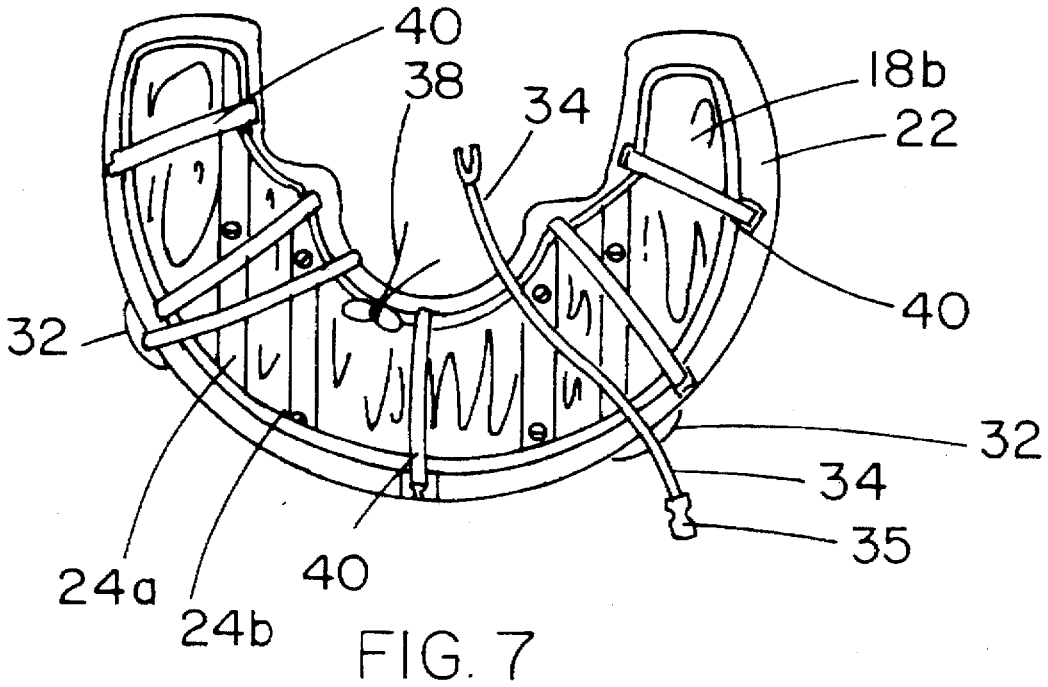
FIG. 7 is a schematic bottom plan view of the device of FIG. 1 with the cover in place.

FIG. 7 illustrates the bottom of device 10 with cover 22 in place in snug position by use of a drawstring 38 which passes through the hem around the perimeter of cover 22 in known manner. Cover 22 is preferably formed of a machine washable fabric such as cotton, for the comfort of the babies and the convenience of the mother or other care-giver. However, it may also include a layer of plastic sheeting to further protect cushion 20 in case of leaky diapers or other inadvertent spills. Cover 22 can be easily removed for cleaning and replacement as desired, whether attached by a drawstring, as shown or other equally useful, known connectors. Of course, if necessary, for example if at nursing time cover 22 is still damp from washing, device 10 can be made use of without a cover at all. In such case (although certainly not as desireable), babies B1, B2 can be secured directly upon pad 20, without the interposed cover 22, and restrained carefully by straps 34 passed under platform 18 and over pad 20. It is to be emphasized that this use should be the exception rather than the rule.

Ideally, cover 22 is formed to a shape which generally matches the shape of platform 18, but is sufficiently larger than the top surface dimensions of the pad and the depth of the pad and platform combined as to be capable of being folded or wrapped completly around all edges of the platform and pad and then pulled together snugly adjacent to lower surface 18b by drawstring 38 passing through the hem of the cover.

FIGS. 1 and 3 illustrate that cover 22 is preferably provided with a strip 30 of one side of commercially available hook and loop fastener material, which strip faces outwardly around substantially the entire outer perimeter of device 10. With the aid of smaller strips or pieces 32 of the opposite side of the hook and loop fastener material various objects, such as toys, extra diapers, etc. (not shown) can be suspended from the front of device 10 within easy reach of mother M for use as needed. Generally, the objects which will be suspended from cover 22 will be small and light enough in weight so as not to pull the attachment means, such as strips 30/32 from each other or from the cover, or to cause the cover to shift out of its desired position.

In similar manner, baby retention straps, such as those shown at 34, 36 for example, can be positioned where preferred around device 10 for securing the nursing babies to the padded platform. The straps shown in the examples consist of adjustable types readily available in the market place. Straps 34 are preferably of a type made of nylon web and having an easily manipulated buckle 35 at the opposed ends thereof.

Straps 34 may especially be useful with very small infants by simply fastening the strap around the baby's torso, such as when the baby is in the position of baby B2 in FIG. 1, and in this case the strap is passed entirely around device 10, passing under surface 18b, upwardly between corresponding, interconnecting pieces of hook and loop fastener material and upwardly over the top of device 10. Straps 34 or any equivalent thereto must be connected loosely enough so that the baby is comfortable and yet snugly enough that the attached infant cannot move enough to fall from the top of device 10.

Figure 4:
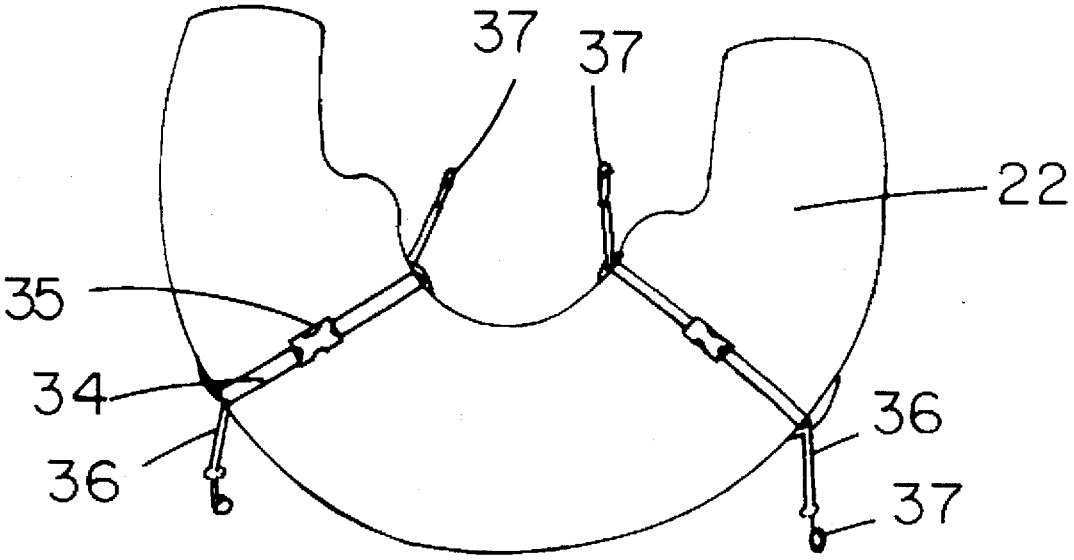
FIG. 4 is a schematic top plan view of the cover of the device of FIG. 1 with an alternative type of strap attachment.

Alternatively, baby B1 is shown wearing a purchased harness 39 which can be connected to device 10 by a thumb-operable clip 37 such as that shown at the ends of straps 36 shown in FIG. 4. When the baby is appropriately attached to device 10 it is a simple matter for mother M to position the baby for nursing, such as illustrated by the position of baby B2, or to move the baby to a seated position as illustrated by baby B1, as may be desired for burping, reading, or playing, etc. as the other infant continues to nurse. The many available options for use are readily apparent upon viewing the figures and with generally known experience in infant care.

FIG. 7 illustrates the above-described straps 34 as they pass as preferred beneath the lower surface 18b of platform 18. Additional hook and loop fastener assembly strips 40 are preferred to be added at spaced intervals beneath surface 18b to connect opposed lower edges of cover 22 and retain it in its position on over pad 20 and platform 18. The passage of straps 34 and/or 36 around the entire assembled device 10 further secures cover 22 in its use position shown.

Figure 9:
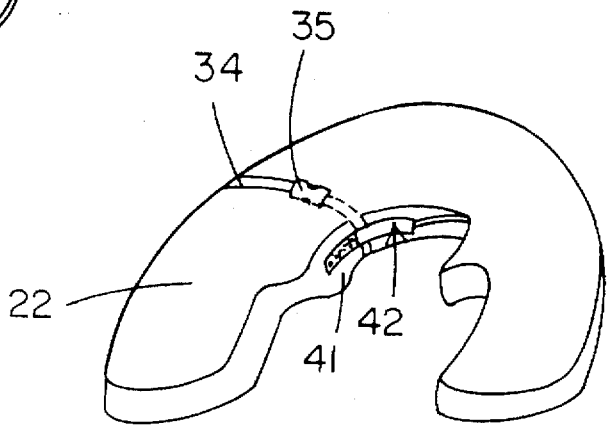
FIG. 9 is a schematic rear perspective view of the device of FIG. 1 with the cover in place, minus some of the straps.

FIG. 9 shows the inside, back or mother's side view of cover 22 in postion on device 10. In this example a strap 34 is illustrated as secured on the inside, concave perimeter 41 of the device as well, again by a hook and loop strip fastener assembly 42 arranged on the cover itself. In each case of the use of strips of hook and loop fasteners, it is understood that such material may be connected to cover 22 by any convenient method, such as by gluing or sewing. Moreover, although such assemblies 30, 32, 40, 42 are preferred for ease of use, washability, ready manipulation by mother M, etc., it is understood that other types of connectors, such as other, straps, tape, snapping arrangements and the like may suffice as substitutes without departing from the scope of the invention.

Thus, it may be seen that the new nursing device can make the seemingly overwhelming task of nursing multiple infants effectively as easy as nursing one baby. The feeding time for twins is cut at least in half and the mother can simultaneous attend to other tasks as well. With the availability of the new device 10, more mothers of multiple infants will be encouraged to breast feed their babies, rather than relying entirely on bottle feeding, to the emotional and physical benefit of the infants, by increased maternal contact and breast milk intake. The convenience and health of the mother are enhanced as well, since less time is required for feeding, leaving more time to rest and to attend to other matters.

In view of the foregoing, it will be seen that the several objects of the invention are achieved and other advantages are attained.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. A device for use by a care-giver, the device being adapted for support of two infants for simultaneous feeding thereof by the care-giver, the device comprising:

a rigid platform having an upper flat surface and a lower flat surface, the upper flat surface for providing a support surface for two infants to be fed simultaneously by the care-giver, and for support of the arms of the care-giver, and the lower flat surface contacting and resting upon arms of a chair in which the care-giver using the device is seated, a cushion disposed on the rigid platform to thereby provide a more comfortable surface for supporting the infants during simultaneous feeding of the infants by the user of the device, and a cover over the cushion, to thereby prevent direct contact of the infants with said cushion, straps connected to said device, the straps being of sufficient length to extend around the device with the cushion thereon and adapted to be loosely connected to the infants supported on the device, whereby the infants can be comfortably restrained upon the device and prevented from falling therefrom, wherein said rigid platform is provided with an outer edge and an inner edge and extends continuously therebetween, the inner edge having a concave, generally arcuate form for extending at least partly around and in front of the care-giver in normal use position, and extending rearwardly beyond a back of the chair upon which the device rests during use, to provide an area for support of the elbows of the care-giver, and the inner edge curving laterally and then forwardly to intersect and extend continuously into the outer edge, a center of the outer edge being spaced outwardly from a center of the inner edge, providing a surface area therebetween for support of the infants to be fed.

2. The device of claim 1, wherein said cover is selectively removable.

3. The device of claim 1, wherein said cover is formed of flexible sheet-like material.

4. The device of claim 3, wherein said cover is made of cloth.

5. The device of claim 3, wherein said cover is comprised of plastic sheeting.

6. The device of claim 1, wherein said cover is defined by a perimeter having a hem and includes a drawstring disposed within the hem, to thereby retain said cover in position over said cushion.

7. The device of claim 1, wherein said cover is shaped to generally correspond to the shape of a perimeter of said rigid platform.

8. The device of claim 7, wherein said cover is provided with means for selectively releasably connecting objects to said device within reach of said care-giver.

9. The device of claim 1, wherein said rigid platform is formed of plywood.

10. The device of claim 9, wherein said rigid platform is approximately ½ inch thick.

11. The device of claim 1, wherein said rigid platform is formed of plastic.

12. The device of claim 1, wherein said rigid platform has a perimeter which is smooth to thereby eliminate snagging of the cover thereon.

13. The device of claim 1, wherein said rigid platform and said cushion each have an exterior perimeter which is shaped and sized to correspond to the shape and size of the exterior perimeter of the the other.

14. The device of claim 1, wherein two sets of paired, parallel spaced-apart bars are attached to the bottom of said rigid platform, extending outwardly substantially in front of the seated care-giver when said device is in normal use position, said sets of paired, parallel, spaced-apart bars being sufficiently spaced from one another so as to be disposed on each side of and substantially parallel to respective arms of the chair upon which said platform is disposed.

15. The device of claim 1, wherein said cushion is formed of high density foam rubber material.

16. The device of claim 15, wherein said cushion is two inches thick.

17. A device for use by a care-giver, the device being adapted for support of two infants for simultaneous feeding thereof by the care-giver, the device comprising:

a rigid platform having an upper flat surface and a lower flat surface, the upper flat surface for providing a support surface for two infants to be fed simultaneously by the care-giver, and for support of the arms of the care-giver, and the lower flat surface contacting and resting upon arms of a chair in which the care-giver using the device is seated, wherein said rigid platform is provided with an outer edge and an inner edge and extends continuously therebetween, the inner edge comprising a cut-out open area having a U-shape, the stepped U-shaped defining a front portion having a concave, generally arcuate form for extending at least partly around and in front of the care-giver in normal use position, and a rear portion for extending rearwardly beyond a back of the chair upon which the device rests during use, said rear portion of the stepped U-shape having a width greater than that of the front portion, the surface of the device to provide an area for support of the elbows of the care-giver, and the inner edge curving laterally and then forwardly to intersect and extend continuously into the outer edge, a center of the outer edge being spaced outwardly from a center of the inner edge, providing a surface area therebetween for support of the infants to be fed.

* * * * *